US007950904B2

(12) United States Patent
Park

(10) Patent No.: US 7,950,904 B2
(45) Date of Patent: May 31, 2011

(54) COMPRESSOR

(75) Inventor: Tae-Young Park, Daejeon (KR)

(73) Assignee: Halla Climate Control Corp., Daejeon (KR)

( * ) Notice: Subject to any disclaimer, the term of this patent is extended or adjusted under 35 U.S.C. 154(b) by 356 days.

(21) Appl. No.: 11/782,033

(22) Filed: Jul. 24, 2007

(65) Prior Publication Data

US 2008/0019844 A1 Jan. 24, 2008

(30) Foreign Application Priority Data

Jul. 24, 2006 (KR) ..... 10-2006-0068836

(51) Int. Cl.
*F04B 1/12* (2006.01)
*F04B 27/08* (2006.01)

(52) U.S. Cl. ..... 417/269; 417/271

(58) Field of Classification Search ..... 417/269, 417/271; 418/49–53; 91/499, 505–506
See application file for complete search history.

(56) References Cited

U.S. PATENT DOCUMENTS

| | | | | |
|---|---|---|---|---|
| 3,057,545 | A * | 10/1962 | Ransom et al. | 417/269 |
| 3,888,604 | A | 6/1975 | Oshima et al. | |
| 3,981,629 | A * | 9/1976 | Nakayama et al. | 417/269 |
| 4,974,702 | A * | 12/1990 | Yokomachi et al. | 184/6.17 |
| 5,183,394 | A * | 2/1993 | Fujii et al. | 417/269 |
| 2004/0197202 | A1 * | 10/2004 | Saiki et al. | 417/269 |

FOREIGN PATENT DOCUMENTS

| | | |
|---|---|---|
| EP | 1314888 | 5/2003 |
| JP | 08061230 | 3/1996 |
| JP | 10110675 | 4/1998 |

* cited by examiner

*Primary Examiner* — Devon C Kramer
*Assistant Examiner* — Christopher Bobish
(74) *Attorney, Agent, or Firm* — Lowe Hauptman Ham & Berner LLP

(57) ABSTRACT

The present invention relates to a compressor which secures a sufficient refrigerant inhaling passage so as to minimize a refrigerant inhaling resistance and also to increase lubricating action with respect to a thrust bearing supporting a swash plate, in a structure that refrigerant is inhaled to a cylinder bore through a hollow drive shaft, thereby improving the performance of the compressor.

7 Claims, 4 Drawing Sheets

- Prior Art -

- Prior Art -

COMPRESSOR

RELATED APPLICATIONS

The present application is based on, and claims priority from, KR Application Number 10-2006-0068836, filed Jul. 24, 2006, the disclosure of which is hereby incorporated by reference herein in its entirety.

BACKGROUND OF THE INVENTION

1. Field of the Invention

The present invention relates to a compressor, more particularly, to a compressor which secures a sufficient refrigerant inhaling passage so as to minimize a refrigerant inhaling resistance and also to increase lubricating action with respect to a thrust bearing supporting a swash plate, in a structure that refrigerant is inhaled to a cylinder bore through a hollow drive shaft, thereby improving the performance of the compressor.

2. Description of the Related Art

Generally, a compressor for vehicle inhales refrigerant gas which is vaporized and discharged from an evaporator and transforms it into refrigerant gas of high pressure and high temperature so as to be liquified easily and then discharges the transformed refrigerant gas to a condenser.

The compressor is classified into a swash plate type compressor in which a piston is reciprocated by rotation of a swash plate, a scroll type compressor which compresses refrigerant by rotation of two scrolls, a vane rotary type compressor which compresses the refrigerant by rotating vane and the like.

Among them, a reciprocating compressor which compresses the refrigerant by reciprocating of the piston further includes a crank type and a wobble plate type and the like besides the swash plate type. The swash plate type compressor is also classified into a variable capacity type and a fixed capacity type.

FIGS. 1 and 2 show a conventional fixed capacity type swash plate compressor.

As shown in the drawings, the swash plate type compressor 1 includes a front housing 10 in which a front cylinder block 20 is provided and a rear housing 10*a* which is coupled with the front housing 10 and in which a rear cylinder block 20*a* is provided.

In the front and rear housings 10 and 10*a*, there are respectively formed a discharge chamber 12 and a suction chamber 11 inside and outside a partition wall 13 corresponding to a refrigerant outlet hole and a refrigerant inlet hole of a valve plate 61 to be described below.

The discharge chamber 12 is formed with a first discharge chamber 12*a* which is formed inside the partition wall 13 and a second discharge chamber 12*b* which is formed outside the partition wall 13 so as to be isolated from the suction chamber 11 and to be communicated with the first discharge chamber 12*a* through a discharging hole 12*c*.

That is, the refrigerant in the first discharge chamber 12*a* is contracted when passing through the discharging hole 12*c* having a small diameter and then expanded when moving to the second discharge chamber 12*b*. While the refrigerant is contacted and expanded, pulsation pressure is lowered, thereby reducing vibration and noise.

Meanwhile, a plurality of bolt holes 16 are formed in the circumferential direction of the suction chamber 11. Through the bolt holes 16, the front and rear housings 10 and 10*a* are coupled to each other by bolts 80 in the status that a plurality parts are assembled therein.

The front and rear cylinder blocks 20 and 20*a* are formed with a plurality of cylinder bores 21 therein. The pistons 50 are inserted into the cylinder bores 21 of the front and rear cylinder blocks 20 and 20*a*, which are correspondent to each other, so as to be linearly reciprocated, and the pistons 50 are coupled through shoes 45 to the circumference of the swash plate 40 which is inclinedly coupled to a drive shaft 30.

Therefore, the pistons 50 is interlocked with the swash plate 40 rotated together with the drive shaft 30, and thus reciprocated in the cylinder bores 21 of the front and rear cylinder blocks 20 and 20*a*.

A valve unit 60 is disposed between the front and rear housings 10 and 10*a* and the front and rear cylinder blocks 20 and 20*a*.

The valve unit 60 is formed with a valve plate 61 having the refrigerant inlet hole and the refrigerant outlet hole, and a suction lead valve 63 and a discharge lead valve 62 disposed at both side surfaces thereof.

The valve unit 60 is respectively assembled between the front and rear housings 10 and 10*a* and the front and rear cylinder blocks 20 and 20*a*. At this time, fixing pins 65 formed at both sides of the valve plate 61 are respectively inserted into fixing holes 15 formed at surfaces of the front and rear housings 10 and 10*a* and the front and rear cylinder blocks 20 and 20*a* opposite to each other, so that the valve unit 60 can be positioned at a place.

Meanwhile, a plurality of communication passage 22 are formed at the front and rear cylinder blocks 20 and 20*a* so that the refrigerant supplied to a swash plate chamber 24 provided between the front and rear cylinder blocks 20 and 20*a* can be flowed to the suction chamber 11. The second discharge chambers 12*b* of the front and rear housings 10 and 10*a* are connected to each other through a connecting path 23 passing through the front and rear cylinder blocks 20 and 20*a*.

Accordingly, the inhaling and compressing of the refrigerant are simultaneously performed in the cylinder bores 21 of the front and rear cylinder blocks 20 and 20*a* according to the reciprocating of the pistons 50.

And a shaft supporting hole 25 for supporting the drive shaft 30 is formed at a center protion of the front and rear cylinder blocks 20 and 20*a*, and a needle roller bearing is provided in the shaft supporting hole 25 so as to rotatably support the drive shaft 30.

Meanwhile, at an upper outer surface of the rear housing 10*a*, there is formed a muffler 70 which functions to supply the refrigerant transferred from the evaporator to the compressor upon an intake stroke of the piston 50 and discharge the refrigerant compressed in the compressor 1 to the condenser upon a compression stroke of the piston.

Hereinafter, refrigerant circulating processes of the compressor 1 as described above will be described.

The refrigerant supplied from the evaporator is inhaled to a suction part of the muffler 70 and then supplied through a refrigerant inlet port 71 to the swash plate chamber 24 provided between the front and rear cylinder blocks 20 and 20*a*, and the refrigerant supplied to the swash plate chamber 24 is flowed to the suction chamber 11 of the front and rear housings 10 and 10*a* along the communication passage 22 formed at the front and rear cylinder blocks 20 and 20*a*.

Then, the suction lead valve 63 is opened upon the intake stroke of the piston 50. At this time, the refrigerant in the suction chamber 11 is inhaled into the cylinder bore 21 through the refrigerant suction hole of the valve plate.

The refrigerant in the cylinder bore 21 is compressed upon the compression stroke of the piston 50. At this time, if the discharging lead valve 62 is opened, the refrigerant is flowed to the first discharge chamber 12*a* of the front and rear housings 10 and 10*a* through the refrigerant outlet hole of the valve plate.

Sequentially, the refrigerant flowed to the first discharge chamber 12*a* is discharged to a discharging part of the muffler 70 through the second discharge chamber 12*b* and the refrigerant discharging port 72 of the muffler 70, and then flowed to the condenser.

Meanwhile, the refrigerant compressed in the cylinder bore 21 of the front cylinder block 20 is discharged to the first discharge chamber 12*a* of the front housing 10, and flowed to the second discharge chamber 12*b*, and flowed to the second discharge chamber 12*b* of the rear housing 10*a* through the connecting path 23 formed at the front and rear cylinder blocks 20 and 20*a*, and then discharged to the discharging part of the muffler 70 through the refrigerant outlet port 72 together with other refrigerant remained therein.

However, the conventional compressor 1 has a problem that a suction volume efficiency of refrigerant is deteriorated by a loss due to inhaling resistance generated by the complicated refrigerant paths, a loss due to elastic resistance of the suction lead valve 63 upon the opening/closing of the valve unit 60 and the like.

Meanwhile, in order to reduce the loss caused by the elastic resistance of the suction lead valve 63, there has been provided Korean Patent Laid-Open No. 2003-47729 (entitled "Lubricating structure in fixed capacitance type piston compressor"). That is, in the above technology, a suction rotary valve in which a drive shaft is integrally formed without the suction lead valve is employed. Also in order to reduce the loss by the inhaling resistance, the refrigerant can be directly flowed from a rear side of the drive shaft to the cylinder bore through an inner side of the drive shaft.

In the case of the above-mentioned compressors, oil is mixed with the refrigerant in order to lubricate the driving parts (swash plate, shoes, pistons and the like) and a friction part.

Moreover, in Korean Patent Application No. 2005-74185 filed by the applicant, a passage is formed in a drive shaft to which a swash plate is inclined coupled so as to be rotated in a swash plate chamber in the compressor, so that refrigerant inhaled in the compressor can be flowed to a cylinder bore formed in a cylinder block. Inlet and outlet holes are formed at both side of the passage so as to be spaced apart at a distance.

Herein, the inlet hole of the passage is formed to perforate a hub of the swash plate and a side of the drive shaft, or formed at both sides of the drive shaft in the opposite direction. In the latter case, the inlet holes are formed to be spaced apart from each other so that one of them is not opposed to the other.

Further, the outlet hole of the passage is communicated with a inhaling passage of each cylinder bore, and formed at both sides of the drive shaft in the opposite direction so that the refrigerant is inhaled into each cylinder bore formed at both sides of the swash plate chamber at the same time when the drive shaft is rotated.

However, in the case of Korean Patent Laid-Open No. 2003-47729, there is a limitation in forming a refrigerant inhaling passage at a rear side of the drive shaft and increasing the size thereof. Therefore, it is difficult to secure the sufficient refrigerant inhaling passage. In the case of Korean Patent Application No. 2005-74185, since there is a limitation in increasing a size of the passage, the refrigerant inhaling resistance is increased. Further, since it is difficult to sufficiently lubricate the thrust bear, friction force at the thrust bearing is increased, thereby reducing its durability.

DISCLOSURE OF THE INVENTION

It is an object of the present invention to provide a a compressor which secures a sufficient refrigerant inhaling passage so as to minimize a refrigerant inhaling resistance and also to increase lubricating action with respect to a thrust bearing supporting a swash plate, in a structure that refrigerant is inhaled to a cylinder bore through a hollow drive shaft, thereby improving the performance of the compressor.

To achieve the object, there is provided a The compressor including a drive shaft to which a swash plate is inclined coupled so as to be rotated in a swash plate chamber in the compressor, and a passage through which refrigerant inhaled from an outside into the compressor is formed therein, and the passage is formed with at least one inlet hole communicated with a swash plate chamber and a pair of outlet holes formed in an opposite direction to each other apart from the inlet hole; front and rear cylinder blocks in which the drive shaft is rotatably disposed at a shaft supporting hole and a plurality of cylinder bores are formed at both sides of the swash plate chamber, and which has a communication passage for communicating the shaft supporting hole and each cylinder bore so that the refrigerant inhaled into the passage can be inhaled into each cylinder bore, in turn, when the drive shaft is rotated; a plurality of pistons which are respectively coupled through shoes to a circumference of the swash plate and receiprocated in the cylinder bores according to the rotation of the swash plate; a thrust bearing which is disposed between the swash plate and the cylinder blocks so as to support both sides of the swash plate and also coupled to the drive shaft; front and rear housings which are coupled to both sides of the front and rear cylinder blocks so as to have a discharge chamber therein; and a valve unit which is disposed between the front and rear cylinder blocks and the front and rear housings, and at least one sub-inlet hole of which one end is contacted with the thrust bearing and the other is communicated with the inlet hole of the passage.

Further, in the present invention, the inlet holes of the passage are formed in one pair in an opposite direction to each other so as to vertically penetrate both sides of the drive shaft and a hub of the swash plate, and the outlet hole is communicated with the suction path of the cylinder blocks.

Further, in the present invention, the sub-inlet holes are formed in one pair in an opposite direction to each other so as to horizontally penetrate a side of a hub of the swash plate and vertically intersect with the inlet hole of the passage.

Further, in the present invention, the valve unit is provided with a valve plate having a plurality of refrigerant discharging holes through which each cylinder bore is communicated with the discharge chamber of the front and rear housings, and a discharging lead valve which is disposed at a side of the valve plate so as to open and close the refrigerant discharging hole.

DETAILED DESCRIPTION OF MAIN ELEMENTS

| | |
|---|---|
| 100: | compressor |
| 110: | front housing |
| 111, 121: | discharge chamber |
| 112, 122: | fixing hole |
| 113, 123: | bolt hole |
| 120: | rear housing |
| 130: | front cylinder block |
| 131, 141: | cylinder bore |
| 132, 142: | communication passage |
| 133, 143: | shaft supporting hole |
| 134, 144: | discharge path |
| 135, 145: | muffler |
| 136: | swash plate chamber |
| 140: | rear cylinder block |
| 146: | inlet port |
| 147: | outlet port |
| 150: | drive shaft |
| 151: | passage |
| 152: | inlet hole |
| 153: | outlet hole |
| 154: | sub-inlet hole |
| 160: | swash plate |
| 161: | hub |
| 165: | shoe |
| 170: | piston |
| 180: | thrust bearing |
| 181, 182: | race |
| 183: | roller |
| 190: | valve unit |
| 191: | valve plate |
| 191a: | refrigerant discharging hole |
| 191b: | communication path |
| 192: | discharging lead valve |
| 192a: | valve plate |
| 193: | fixing pin |
| 200: | bolt |

DETAILED DESCRIPTION OF THE PREFERRED EMBODIMENT

Practical and presently preferred embodiments of the present invention are illustrative as shown in the following Examples and Comparative Examples.

However, it will be appreciated that those skilled in the art, on consideration of this disclosure, may make modifications and improvements within the spirit and scope of the present invention.

Figure 1:
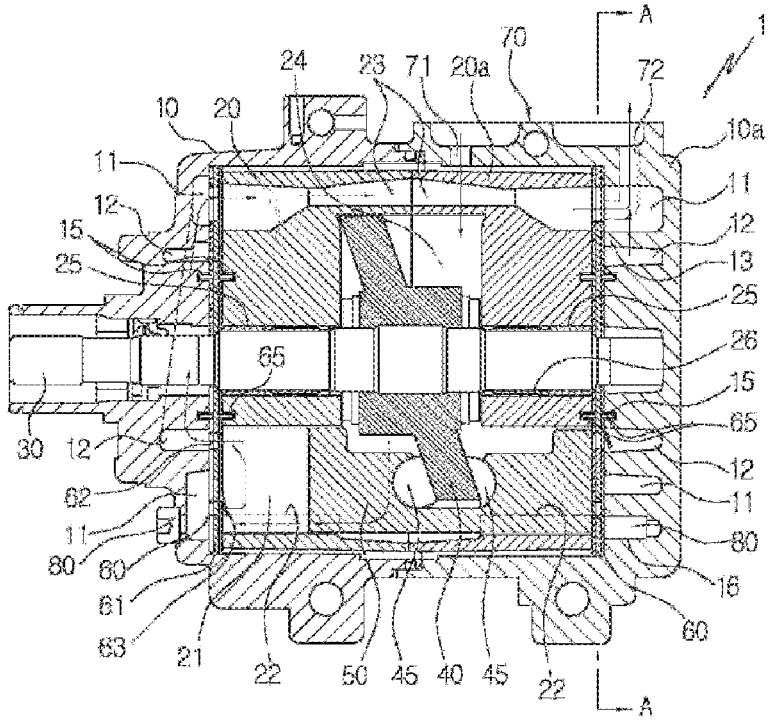
FIG. 1 is a cross-sectional view of a conventional compressor.
Figure 2:
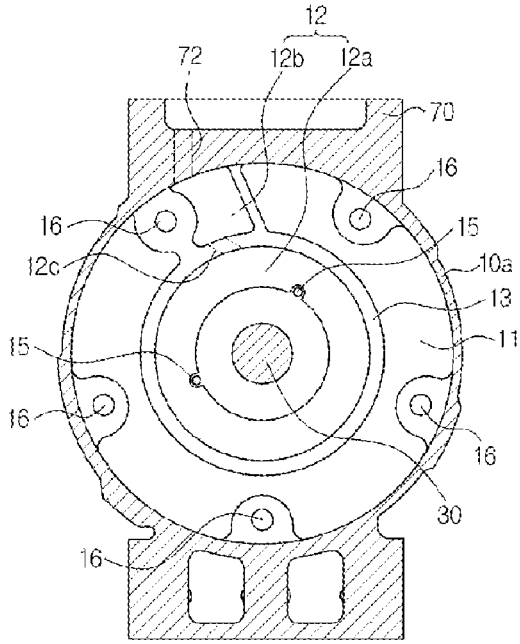
FIG. 2 is a cross-sectional view taken along a line of A-A of FIG. 1.
Figure 3:
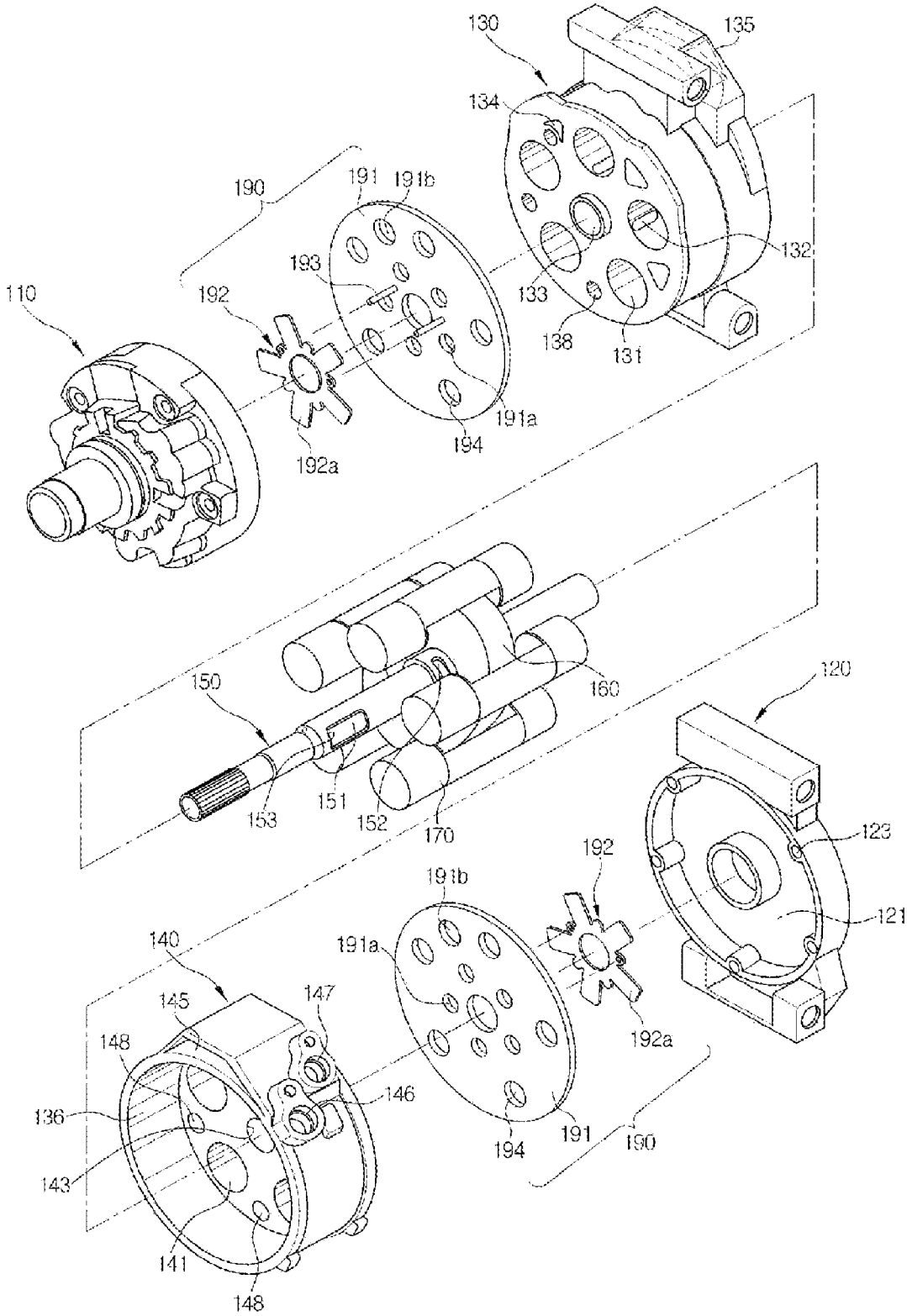
FIG. 3 is an exploded perspective view of a compressor according to the present invention.
Figure 4:
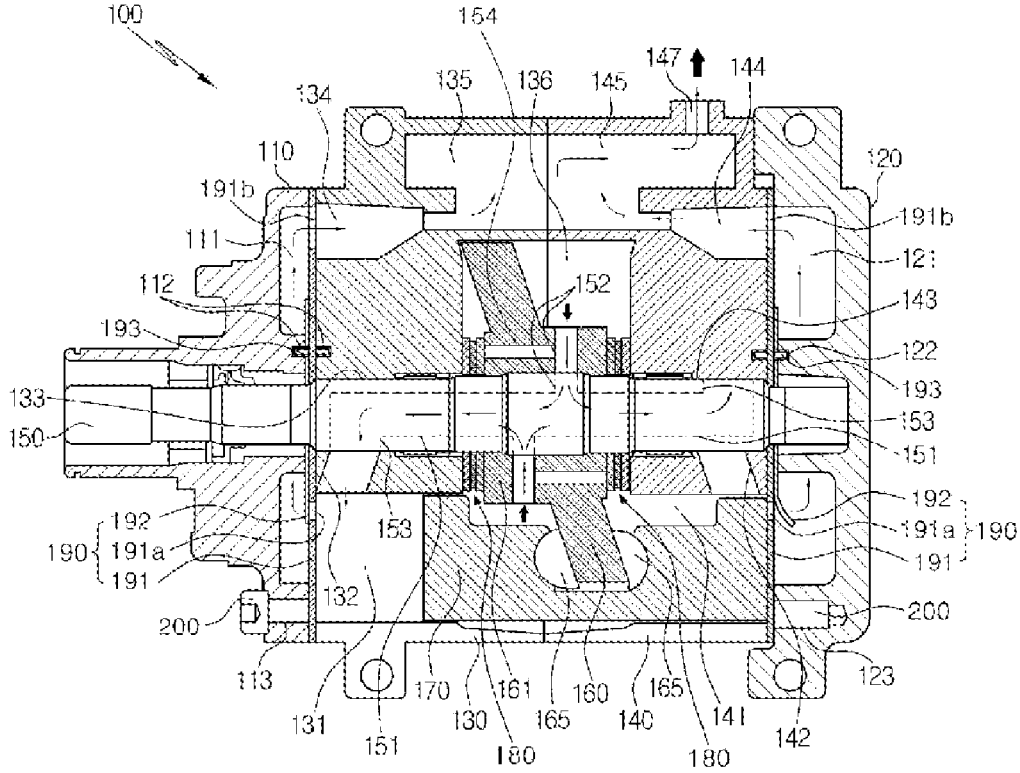
FIG. 4 is a cross-sectional view of the compressor according to the present invention.
Figure 5:
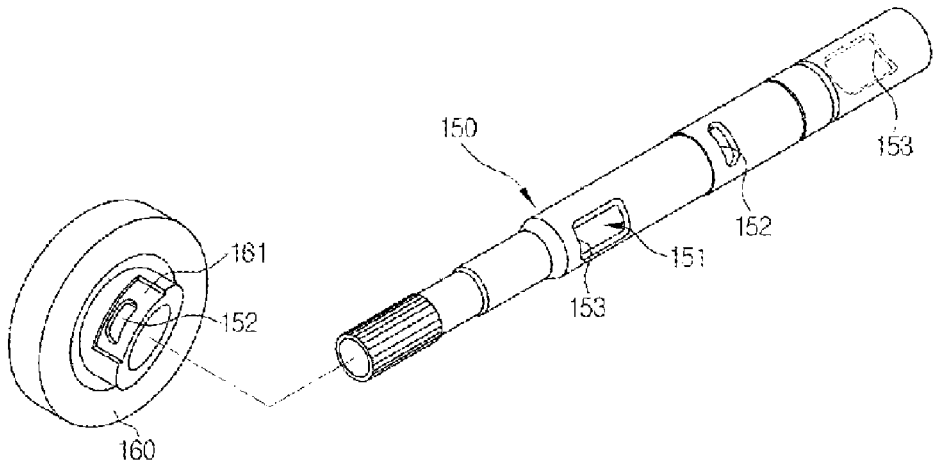
FIG. 5 is a perspective view of a drive shaft and a swash plate, which are disassembled from each other, in the compressor according to the present invention.
Figure 6:
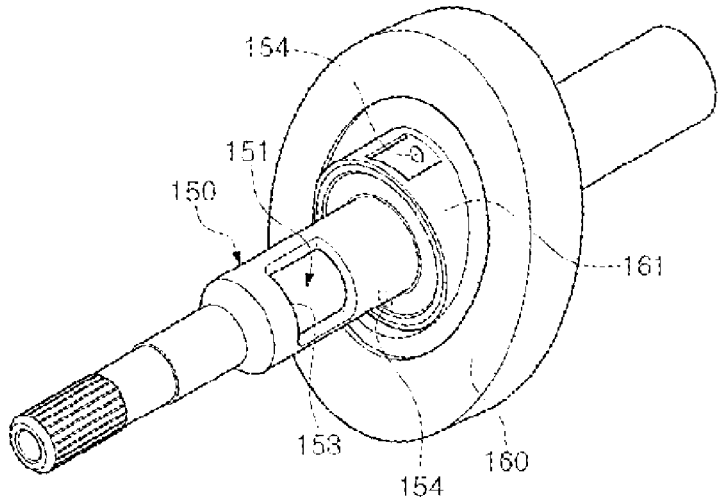
FIG. 6 is a perspective view of the drive shaft and the swash plate, which are assembled with each other, in the compressor according to the present invention.
Figure 7:
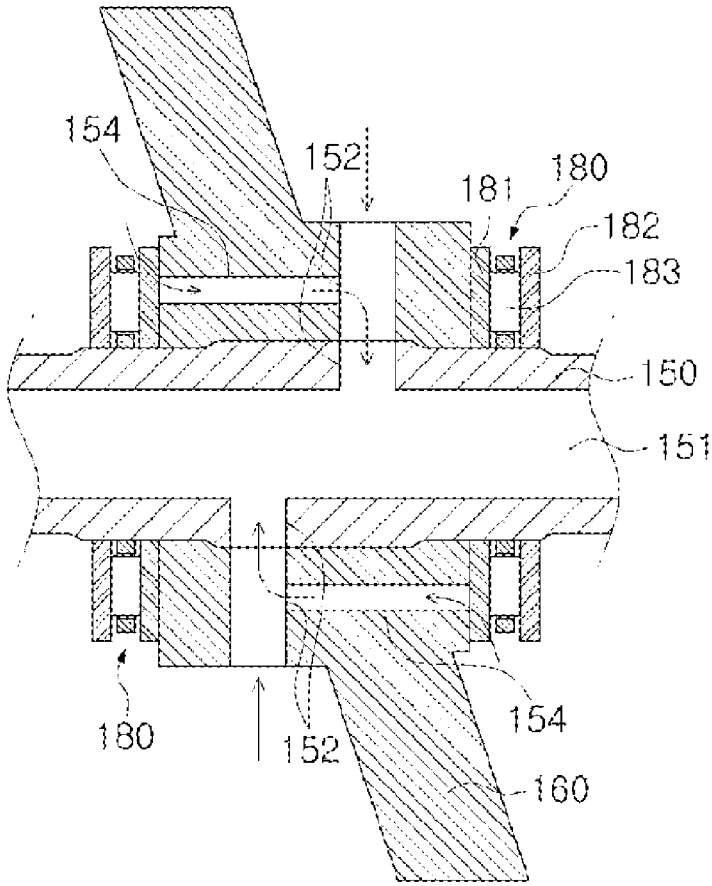
FIG. 7 is a view showing a structure of the drive shaft and a thrust bearing of the compressor according to the present invention.

FIG. 3 is an exploded perspective view of a compressor according to the preferred embodiment of the present invention, FIG. 4 is a cross-sectional view of the compressor of FIG. 3, FIG. 5 is a perspective view of a drive shaft and a swash plate, which are disassembled from each other, in the compressor according to FIG. 3, FIG. 6 is a perspective view of the drive shaft and the swash plate, which are assembled with each other, in the compressor according to FIG. 3 and FIG. 7 is a view of a structure of the drive shaft and a thrust bearing of the compressor of FIG. 3.

The present invention employs a compressor structure in which refrigerant supplied to a swash plate chamber can be directly inhaled into cylinder bores through an internal portion of a hollow drive shaft.

The compressor structure includes a passage in the drive shaft, and the refrigerant supplied to the swash plate chamber is directly inhaled into the cylinder bores through the passage when the drive shaft is rotated. Thus, the refrigerant is uniformly distributed to each cylinder bore positioned at both sides of the swash plate chamber, and the amount of refrigerant flowing to the driving parts (such as the swash plate in the swash plate chamber and the drive shaft) is increased, thereby improving the lubricating performance due to oil.

Such a compressor structure minimizes the inhaling resistance of the refrigerant and improves the lubricating performance at the thrust bearing which supports the swash plate.

As shown in the drawings, the compressor 100 includes a drive shaft 150 to which a swash plate 160 is inclined coupled so as to be rotated in a swash plate chamber 136 in the compressor 100, front and rear cylinder blocks 130 and 140 in which the drive shaft 150 is rotatably disposed at a shaft supporting hole 133, 143, a plurality of pistons 170 which are respectively coupled through shoes 165 to a circumference of the swash plate 160 and reciprocated in the cylinder bores 131 and 141 formed at both sides of the swash plate chamber 136 of the front and rear cylinder blocks 130 and 140 according to rotation of the swash plate 160, front and rear housings 110 and 120 which are coupled to both sides of the front and rear cylinder blocks 130 and 140 so as to have a discharge chamber 111, 121 therein, and a valve unit 190 which is disposed between the front and rear cylinder blocks 130 and 140 and the front and rear housings 110 and 120.

A plurality of bolt holes 113 and 123 are formed at inner edges of the front and rear housings 110 and 120. Through the bolt holes 113 and 123, the front and rear housings 110 and 120 are coupled to each other by bolts 200 in the status that a plurality parts are assembled therein. Of course, at the front and rear cylinder blocks 130 and 140 and the valve unit 190, there are also formed bolt holes 138, 148 and 194 through which the bolts 200 are passed.

Both ends of the drive shaft 150 are rotatably inserted into the shaft supporting holes 133 and 143 of the front and rear cylinder blocks 130 and 140. Herein, one of the ends is extended so as to pass through a center portion of the front housing 110 and then connected with an electro-magnetic clutch (not shown).

Meanwhile, during operation of the compressor 100, the swash plate 160 is rotated in an inclined state so as to move the pistons 170 to the front and rear sides. Thus, since the swash plate 160 is joggled in the right and left direction, it is apprehended that the swash plate 160 or the drive shaft 150 is deformed. In order to prevent the problem, a thrust bearing 180 is interposed between both ends of the swash plate 160 and the front and rear cylinder blocks 130 and 140. As shown in FIG. 7, the thrust bearing 180 includes a race 181 which is contacted with the swash plate 160, a race 182 which is contacted with the cylinder block 130, 140 and a plurality of needle type rollers 183 which are disposed between the first and second races 181 and 182.

The swash plate 160 which is rotated in the swash plate chamber 136 is inclinedly coupled with the drive shaft. In the drive shaft 150, there is formed a passage 151 through which the swash plate 136 and the cylinder bore 131, 141 are commnunicated with each other so that the refrigerant inhaled in the swash plate chamber 136 from an outside through an inlet port 146 can be flowed through the swash plate 160 to the cylinder bore 131, 141.

The passage 151 is formed with an inlet hole 152 as a refrigerant inhaling port for inhaling the refrigerant and an outlet hole 153 for discharging the refrigerant, and the inlet hole 152 and the outlet hole 153 are spaced apart from each other. The inlet hole 152 is communicated with the swash plate chamber 136, and the outlet hole 153 is communicated with each communication passage 132, 142 of the front and rear cylinder block 130, 140.

Herein, the inlet hole 152 of the passage 151 is formed to perpendiculary penetrate a side of the drive shaft 150. Only one inlet hole 152 of the passage 151 may be formed at the drive shaft 150, or two inlet holes 152 may be formed at both sides of the drive shaft 150 in the opposite direction to each other.

The outlet hole 153 of the passage 151 is formed at both sides of the drive shaft 150 in the opposite direction so as to be spaced apart from the inlet hole 152. Therefore, when the drive shaft 150 is rotated, the refrigerant can be simultaneously inhaled into each cylinder bore 131, 141 formed at both sides of the swash plate chamber 136.

That is, since the swash plate 160 is disposed to be inclined to one side, some of the plurality of pistons 170, which are disposed in the opposite direction to each other, perform the same intake or compression stroke. Therefore, the both outlet holes 153 of the passage 151 should be formed in the opposite direction to each other, and thus the refrigerant can be inhaled at the same time into the cylinder bores 131 and 141 formed both side of swash plate chamber 136.

Of course, a direction of each outlet holes 153 of the passage 151, which is formed at the drive shaft 150, may be changed according to a design intention like the number of pistons 170.

Meanwhile, the swash plate 160 is formed with a sub-inlet hole 154 of which one end is contacted with the thrust bearing 180 and the other is communicated with the inlet hole 152 of the passage 151.

As shown in FIG. 7, the sub-inlet hole 154 is formed to horizontally penetrate a side of a hub 161 of the swash plate 160 and vertically intersect with the inlet hole 152 of the passage 151. Like in the inlet hole 152 of the passage 151, only one sub-inlet hole 154 may be formed at one side of the hub 161, or two sub-inlet holes 154 may be formed at both sides of the hub 161 in the opposite direction to each other.

As described above, since the inlet hole 152 and the sub-inlet hole 154 are formed at the swash plate 160 so as to be communicated with each other, the refrigerant introduced in the swash plate chamber 136 can be simultaneously inhaled in the passage 151 of the drive shaft 150 through the inlet hole 152 and the sub-inlet hole 154. Therefore, since it is possible to secure the sufficient refrigerant inhaling passage without any limitation in increasing a size thereof like in the conventional compressor, an amount of refrigerant inhaled per unit time is increased, thereby minimizing the refrigerant inhaling resistance in the passage 151 of the drive shaft 150. Further, because one end of the sub-inlet hole 154 is exposed to the side of thrust bearing 180, when the refrigerant introduced in the swash plate chamber 136 is passed, in turn, through the thrust bearing 180, the sub-inlet hole 154 and the inlet hole 152 together with oil contained in the refrigerant and then inhaled into the passage 151 of the drive shaft 150, a contact surface between the roller 183 and the race 181, 182 is lubricated by the oil so as to reduce the friction force therebetween, thereby increasing durability of the thrust bearing 180 and extending a life span thereof. Thus, the performance of the compressor is remarkably improved.

The front and rear cylinder blocks 130 and 140 has the plurality of cylinder bores 131 and 141 at both sides of the swash plate chamber 136 and the shaft supporting holes 133 and 143 at the center portion thereof to support the drive shaft 50.

Further, the front and rear cylinder blocks 130 and 140 is formed with the communication passage 132, 142 which communicates the shaft supporting holes 133 and 143 and the cylinder bores 131 and 141 so that the refrigerant inhaled from the swash plate chamber 136 to the passage 151 of the drive shaft 150 can be inhaled into each cylinder bore, in turn, when the drive shaft 150 is rotated.

Furthermore, at an outer surface of one of the front and rear cylinder blocks 130 and 140, there are formed the inlet port 146 which is communicated with the swash plate chamber 136 so that the refrigerant can be supplied to the swash plate chamber 136, and the outlet port 147 which is communicated with the discharge chamber 111, 121 so that the refrigerant in the discharge chamber 111, 121 can be discharged to the outside.

The front and rear cylinder block 130, 140 is formed with a discharge path 134, 144 which communicates the front and rear housings 110 and 120 and the discharge chamber 111, 121. At the outer surface of the front and rear cylinder blocks 130 and 140, there is formed a muffler 135, 145 which is formed by expanding the discharge path 134, 144 so as to reduce the pulsating pressure of the discharged refrigerant and thus reduce the noise.

The valve unit 190 is provided with a valve plate 191 having a plurality of refrigerant discharging holes 191*a* through which each cylinder bore 131, 141 is communicated with the discharge chamber 111, 121 of the front and rear housings 110 and 120, and a discharging lead valve 192 which is disposed at a side of the valve plate 191 so as to open and close the refrigerant discharging hole 191*a*.

In other words, the discharging lead valve 192 is provided with a valve plate 192*a* which is disposed so as to be directed toward the discharge chamber 111, 121 of the front and rear housings 110 and 120 on the basis of the valve plate 191, and which is elastically deformed so as to open the refrigerant discharging hole 191*a* upon the compression stroke of the piston 170 and close the refrigerant discharging hole 191*a* upon the intake stroke.

Moreover, the valve plate 191 is formed with a communication path 191*b* which communicates the discharge chamber 111, 121 and the discharge path 134, 144 so that the refrigerant in the discharge chamber 111, 121 can be discharged to the outlet port 147 through the discharge path 134, 144 of the front and rear cylinder block 130, 140.

Meanwhile, a fixing pin 193 formed at both surfaces of the valve plate 191 is inserted into the fixing hole 112, 122 formed in opposed surfaces of the front and rear housings 110 and 120 and the front and rear cylinder blocks 130 and 140. And thus the valve unit 190 can be fixedly positioned.

As described above, in the compressor 100 according to the present invention, if drive shaft 150 which is selectively driven by the electro-magnetic clutch (not shown) is rotated, the swash plate 160 is rotated. At this time, the plurality of pistons 170 are reciprocated in the cylinder bores 131 and 141 of the front and rear cylinder block 130 and 140 according to the rotation of the swash plate 160, and thus the inhaling and compressing of the refrigerant are performed repeatedly.

That is, upon the intake stroke of the piston 170, the refrigerant is supplied from the outside to the swash plate chamber 136 through the inlet port 146 and then directly inhaled into the cylinder bores 131 and 141 through the sub-inlet hole 154 and the inlet hole 152 of the passage 151 of the drive shaft 150.

And upon the compression stroke of the piston 170, the refrigerant inhaled into the cylinder bores 131 and 141 is compressed by the piston 170, and discharged to the discharge chamber 111, 121 of the front and rear housing 110, 112 and then discharged to the outlet port 147 through the discharge path 134, 144 of the front and rear cylinder blocks 130 and 140 and the muffler 135, 145.

In the present invention as described above, since the sub-inlet hole is employed to the suction rotary valve type fixed capacitance swash plate compressor in which a drive shaft is integrally formed and the passage 151 is formed in the hollow drive shaft 150 so that the refrigerant inhaled in the swash plate chamber 136 is flowed to the cylinder bores 131 and 141 through the passage 151, it is possible to minimize the inhaling resistance of the refrigerant and lubricate the thrust bearing 180 sufficiently. Also, the present invention can be applied to various types of the compressor with the same method and structure and also obtain the same effect.

INDUSTRIAL APPLICABILITY

According to the present invention, since the sub-inlet hole of which one end is contacted with the thrust bearing and the other is communicated with the inlet hole is further provided at a side of the hub of the swash plate, it is possible to minimize the inhaling resistance of the refrigerant and lubricate the thrust bearing sufficiently, thereby remarkably increasing the performance of the compressor.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

What is claimed is:

1. A compressor, comprising:

a drive shaft to which a swash plate is inclined coupled so as to be rotatable in a swash plate chamber in the compressor, the drive shaft including a passage arranged so refrigerant inhaled from outside can flow through the passage to cylinder bores in the compressor, the passage including at least one inlet hole communicating with a swash plate chamber and a pair of outlet holes positioned in opposite directions to each other and spaced from the inlet hole;

front and rear cylinder blocks including a shaft supporting hole for inserting the drive shaft, a plurality of cylinder bores being formed at both sides of the swash plate chamber, and a communication passage for communicating the shaft supporting hole and each cylinder bore so that refrigerant inhaled into the passage can be inhaled into each cylinder bore in turn, when the drive shaft is rotated;

a plurality of pistons which are respectively coupled through shoes to a circumference of the swash plate and reciprocatable in the cylinder bores according to the rotation of the swash plate;

a thrust bearing between the swash plate and the cylinder blocks and so as to support both sides of the swash plate and also coupled to the drive shaft;

front and rear housings which are coupled to both sides of the front and rear cylinder blocks so as to have a discharge chamber therein;

a valve unit between the front and rear cylinder blocks and the front and rear housings; and the swash plate including at least one sub-inlet hole, one end of the sub-inlet hole opening in a contact surface of a race of the thrust bearing and the other end of the sub-inlet hole communicating with the inlet hole of the passage and arranged to transfer refrigerant in the swash plate chamber to the inlet hole of the passage and to lubricate a contact surface of a roller and the race of the thrust bearing.

2. The compressor according to claim 1, wherein the inlet holes of the passage are formed in one pair in opposite directions to each other so as to vertically penetrate both sides of the drive shaft and a hub of the swash plate, and the outlet holes communicate with the communication passage of the cylinder blocks.

3. The compressor according to claim 2, wherein the at least one sub-inlet hole includes a pair of sub-inlet holes opposite directions to each other so as to horizontally penetrate a side of a hub of the swash plate and vertically intersect the inlet hole of the passage.

4. The compressor according to claim 1, wherein the at least one sub-inlet hole includes a pair of sub-inlet holes positioned in opposite directions to each other so as to horizontally penetrate a side of a hub of the swash plate and vertically intersect the inlet hole of the passage.

5. The compressor according to claim 1, wherein the valve unit includes a valve plate having a plurality of refrigerant discharging holes through which each cylinder bore communicates with the discharge chamber of the front and rear housings and a discharging lead valve at a side of the valve plate so as to open and close the refrigerant discharging hole.

6. The compressor according to claim 1, wherein the other end of the sub-inlet hole in communication with the inlet hold of the passage opens on a side surface of the inlet hole, the side surface being radially extended in the direction of the drive shaft.

7. A compressor, comprising:

a drive shaft to which a swash plate is inclined coupled so as to be rotatable in a swash plate chamber in the compressor, the drive shaft including a passage arranged so refrigerant inhaled from outside can flow through the passage to cylinder bores in the compressor, the passage including at least one inlet hole communicating with a swash plate chamber and a pair of outlet holes positioned in opposite directions to each other and spaced from the inlet hole;

front and rear cylinder blocks including a shaft supporting hole for inserting the drive shaft, a plurality of cylinder bores being formed at both sides of the swash plate chamber, and a communication passage for communicating the shaft supporting hole and each cylinder bore so that refrigerant inhaled into the passage can be inhaled into each cylinder bore in turn, when the drive shaft is rotated;

a plurality of pistons which are respectively coupled through shoes to a circumference of the swash plate and reciprocatable in the cylinder bores according to the rotation of the swash plate;

a thrust bearing between the swash plate and the cylinder blocks and so as to support both sides of the swash plate and also coupled to the drive shaft;

front and rear housings which are coupled to both sides of the front and rear cylinder blocks so as to have a discharge chamber therein;

a valve unit between the front and rear cylinder blocks and the front and rear housings; and the swash plate including at least one sub-inlet hole, one end of the sub-inlet hole contacting a contact surface of a race of the thrust bearing and a hub of the swash plate and the other end of the sub-inlet hole communicating with a side surface extended in the radial direction of the drive shaft of the inlet hole of the passage to transfer refrigerant in the swash plate chamber to the inlet hole of the passage and to lubricate a contact surface of a roller and the race of the thrust bearing, wherein the inlet holes of the passage are formed in one pair in opposite directions to each other so as to vertically penetrate both side of the drive shaft and a hub of the swash plate, and the outlet holes communicate with the communication passage of the cylinder blocks.

* * * * *